US010924838B1

(12) United States Patent
Graff et al.

(10) Patent No.: US 10,924,838 B1
(45) **Date of Patent: *Feb. 16, 2021**

(54) AUDIO DEVICE

(71) Applicant: Bose Corporation, Framingham, MA (US)

(72) Inventors: Allen T. Graff, Sutton, MA (US); Daniel Patrick Baker, Warwick, RI (US)

(73) Assignee: Bose Corporation, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/567,443

(22) Filed: Sep. 11, 2019

(51) Int. Cl.
*H04R 1/00* (2006.01)
*H04R 1/10* (2006.01)

(52) U.S. Cl.
CPC ..... *H04R 1/1008* (2013.01); *H04R 1/105* (2013.01); *H04R 1/1025* (2013.01)

(58) Field of Classification Search
CPC ..... A61F 11/12; F21V 8/00; H04N 5/655; H04R 1/00; H04R 1/10; H04R 1/1008; H04R 1/1025; H04R 1/105; H04R 5/033; H04R 25/00; H04R 25/02; H04R 1/028; H04R 1/1016; H04R 1/1033; H04R 1/1041; H04R 1/1066; H04R 1/1075; H04R 5/0335; H04R 5/04; H04R 25/652; H04W 4/80; G06F 3/165; G10K 11/17873; G10K 11/178; H04M 1/05; H04S 7/303
USPC ..... 181/129, 135; 320/107; 379/430; 381/59, 74, 87, 150, 322, 330, 345, 370, 381/371, 374, 375, 378, 379, 380, 381; 455/575.2, 569.1; 351/118
See application file for complete search history.

(56) References Cited

U.S. PATENT DOCUMENTS 4,893,344 A * 1/1990 Tragardh ..... H04M 1/05 379/430
5,729,615 A * 3/1998 Yang ..... H04R 1/1066 181/129
5,787,166 A * 7/1998 Ullman ..... H04M 1/05 379/430
6,230,029 B1 * 5/2001 Hahn ..... H04B 1/385 379/430
6,804,364 B1 * 10/2004 De Jonge ..... H04M 1/05 381/381
6,914,997 B2 * 7/2005 MacDonald ..... H04R 1/10 381/381
7,841,446 B2 * 11/2010 Leong ..... A61F 11/08 128/867

(Continued)

FOREIGN PATENT DOCUMENTS

WO 2019164553 8/2019

*Primary Examiner* — Gerald Gauthier
(74) *Attorney, Agent, or Firm* — Brian M. Dingman; Dingman IP Law, PC

(57) ABSTRACT

An audio device with a body configured to be worn on or abutting an outer ear of a user. The body comprises an upper curved portion that is configured to be located proximate the upper portion of the outer ear helix and is relatively more compliant about a vertical axis and is less compliant about a horizontal axis. An acoustic module is coupled to the upper curved portion of the body. The acoustic module is configured to locate a sound-emitting opening anteriorly of and proximate the user's ear canal opening when the body is worn on or abutting the outer ear of the user.

20 Claims, 7 Drawing Sheets

(56) References Cited

U.S. PATENT DOCUMENTS 8,311,259 B2 * 11/2012 Pinter ..... H04R 25/407 381/322
8,411,893 B2 * 4/2013 Ito ..... H04R 1/1066 181/135
8,548,186 B2 * 10/2013 Alwicker ..... H04R 1/1058 381/371
8,798,305 B2 * 8/2014 Harper ..... H04R 1/1016 381/374
9,648,407 B2 * 5/2017 Harper ..... H04R 1/1033
9,716,937 B2 * 7/2017 Qian ..... H04R 1/1091
9,900,680 B2 * 2/2018 Milam ..... H04R 1/1041
9,980,075 B1 * 5/2018 Benattar ..... H04S 7/303
10,582,284 B2 * 3/2020 Trainer ..... G10K 11/17857
10,659,943 B2 * 5/2020 Tong ..... H04R 5/033
10,667,061 B2 * 5/2020 Ozden ..... H04R 25/554
10,674,244 B2 * 6/2020 Dominijanni ..... H04R 1/1008
2004/0055811 A1 * 3/2004 Shih ..... H04R 1/105 181/129
2004/0170294 A1 * 9/2004 Murozaki ..... H04R 1/1075 381/379
2004/0229658 A1 * 11/2004 Kim ..... H04M 1/6066 455/569.1
2006/0135223 A1 * 6/2006 Kim ..... H04M 1/6066 455/575.2
2006/0291686 A1 * 12/2006 Hlas ..... H04R 1/086 381/381
2007/0217643 A1 * 9/2007 Chang ..... H04R 1/1066 381/381
2007/0263885 A1 * 11/2007 Jaakkola ..... H04R 1/105 381/150
2007/0291971 A1 * 12/2007 Halteren ..... H04R 25/48 381/322
2008/0152183 A1 * 6/2008 Janik ..... H04M 1/05 381/375
2008/0178435 A1 * 7/2008 Liu ..... H04M 1/05 24/20 R
2008/0298626 A1 * 12/2008 Dean ..... H04R 1/105 381/381
2009/0052719 A1 * 2/2009 Fujiwara ..... H04R 1/105 381/381
2009/0067658 A1 * 3/2009 Lin ..... H04R 1/2842 381/345
2009/0116678 A1 * 5/2009 Bevirt ..... H04M 1/05 381/381
2009/0123000 A1 * 5/2009 Wright ..... H04R 1/105 381/59
2010/0320961 A1 * 12/2010 Castillo ..... H02J 7/0044 320/107
2012/0140976 A1 * 6/2012 Birger ..... H04M 1/05 381/381
2013/0077043 A1 * 3/2013 Moran ..... G02C 5/143 351/118
2013/0148838 A1 * 6/2013 Silvestri ..... H04R 1/02 381/380
2013/0336514 A1 * 12/2013 Kelly ..... H04R 1/105 381/381
2014/0153768 A1 * 6/2014 Hagen ..... H04R 1/105 381/380
2014/0205125 A1 * 7/2014 Triato ..... H04R 1/1066 381/330
2015/0110319 A1 * 4/2015 Mimbs ..... H04R 25/02 381/322
2015/0172802 A1 * 6/2015 Takeno ..... H04R 1/105 381/378
2016/0261942 A1 * 9/2016 Hayden ..... H04R 1/1016
2016/0381448 A1 * 12/2016 Qian ..... H04R 1/105 381/74
2017/0034611 A1 * 2/2017 Maruyama ..... H04R 1/1066
2017/0041701 A1 * 2/2017 Cheng ..... H04R 1/1083
2017/0064427 A1 * 3/2017 Rich ..... H04R 1/1025
2017/0094384 A1 * 3/2017 Trainer ..... H04R 1/105
2017/0099539 A1 * 4/2017 Di Censo ..... H04R 1/1091
2017/0208289 A1 * 7/2017 Feller ..... H04R 1/028
2017/0280220 A1 * 9/2017 Poulsen ..... H04M 1/05
2017/0359644 A1 * 12/2017 Cramer ..... H04R 1/105
2018/0070165 A1 * 3/2018 Hatfield ..... H04R 1/1058
2018/0146279 A1 * 5/2018 Wang ..... H04R 1/1058
2018/0302718 A1 * 10/2018 Jensen ..... H04R 1/1066
2019/0033505 A1 * 1/2019 Cross ..... G02B 6/0001
2019/0069064 A1 * 2/2019 Ott ..... H04R 1/1016
2019/0261077 A1 * 8/2019 Dominijanni ..... H04R 1/105
2020/0037076 A1 * 1/2020 Boulanger ..... H04R 5/0335
2020/0077174 A1 * 3/2020 Solis ..... H04R 1/105
2020/0100011 A1 * 3/2020 Bruss ..... H04R 1/1016
2020/0267464 A1 * 8/2020 Graff ..... H04R 1/1008

* cited by examiner

AUDIO DEVICE

BACKGROUND

This disclosure relates to an audio device that is configured to be worn on or abutting the ear.

Wireless headsets deliver sound to the ear. Most wireless headsets include an earbud that is placed into the ear canal opening. Earbuds can inhibit or prevent the user from hearing speech and ambient sounds. Also, earbuds send a social cue that the user is unavailable for interactions with others.

SUMMARY

All examples and features mentioned below can be combined in any technically possible way.

In one aspect, an audio device includes a body configured to be worn on or abutting an outer ear of a user, wherein the body comprises an upper curved portion that is configured to be located proximate the upper portion of the outer ear helix and is relatively more compliant about a vertical axis and is less compliant about a horizontal axis. An acoustic module is coupled to the upper curved portion of the body. The acoustic module is configured to locate a sound-emitting opening anteriorly of and proximate the user's ear canal opening when the body is worn on or abutting the outer ear of the user.

Examples may include one of the above and/or below features, or any combination thereof. The sound-emitting opening may be located anteriorly of and proximate the tragus of the ear. The acoustic module may be configured to contact the head anteriorly of and proximate the ear. The body of the audio device may further comprise a lower rear portion that is configured to be located at least in part proximate the otobasion inferius. The lower portion of the body may comprise a compliant mechanical structure that is configured to be located proximate the ear root dimple. The lower rear portion of the body may be configured to house a battery power source.

Examples may include one of the above and/or below features, or any combination thereof. The upper curved portion may comprise an inner spine member covered with a soft flexible material. The soft flexible material may comprise a material selected from the group of materials consisting of a thermoplastic elastomer, a thermoplastic urethane, and a silicone. The soft flexible material may be overmolded on the inner spine member. The overmolding may be accomplished in two separate overmolding shots. The upper curved portion may further comprise a flexible printed circuit element that is configured to electrically connect the acoustic module to the lower rear portion of the body. The inner spine member may comprise at least one of polycarbonate, a wire mesh, steel, stainless steel, nitinol, and polyimide. The inner spine member may be relatively more compliant about a vertical axis and less compliant about a horizontal axis.

Examples may include one of the above and/or below features, or any combination thereof. The upper curved portion of the body may extend generally along an arc and may have an out of plane curvature along its extent. The upper curved portion of the body may define a bend along its length and may be configured to be flattened when the body is worn on or abutting the ear, to create forces that pull the acoustic module toward the user's head.

In another aspect, an audio device includes a body configured to be worn on or abutting an outer ear of a user, wherein the body comprises an upper curved portion that comprises an inner flexible spine member covered with a soft flexible material and is configured to be located proximate the upper portion of the outer ear helix. The upper curved portion of the body is relatively more compliant about a vertical axis and is less compliant about a horizontal axis. The body further comprises a lower rear portion that is configured to be located at least in part proximate the otobasion inferius. An acoustic module is coupled to the upper curved portion of the body. The acoustic module is configured to contact the user's head anteriorly of and proximate the ear and locate a sound-emitting opening anteriorly of and proximate the tragus of the ear when the body is worn on or abutting the outer ear of the user.

Examples may include one of the above and/or below features, or any combination thereof. The upper curved portion may further comprise a flexible printed circuit element that is configured to electrically connect the acoustic module to the lower rear portion of the body. The soft flexible material may be overmolded on the inner flexible spine member. The overmolding may be accomplished in two separate overmolding shots. The upper curved portion of the body may extend generally along an arc and may have an out of plane curvature along its extent. The upper curved portion of the body may define a bend along its length and may be configured to be flattened when the body is worn on or abutting the ear, to create forces that pull the acoustic module toward the user's head.

In another aspect, an audio device includes a body configured to be worn on or abutting an outer ear of a user. The body comprises an upper curved portion that comprises an inner flexible spine member covered with a soft flexible material. The upper curved portion extends generally along an arc, has an out of plane curvature along its extent, and is configured to be located proximate the upper portion of the outer ear helix. The upper curved portion is relatively more compliant about a vertical axis and is less compliant about a horizontal axis. A lower rear portion is configured to house a battery power source and be located at least in part proximate the otobasion inferius. An acoustic module is coupled to the upper curved portion of the body. The acoustic module is configured to contact the user's head anteriorly of and proximate the ear and locate a sound-emitting opening anteriorly of and proximate the tragus of the ear when the body is worn on or abutting the outer ear. The upper curved portion of the body further comprises a flexible printed circuit element that is configured to electrically connect the acoustic module to the lower rear portion of the body. The upper curved portion of the body defines a bend along its length and is configured to be flattened when the body is worn on or abutting the ear, to create forces that pull the acoustic module toward the user's head.

DETAILED DESCRIPTION

An audio device, such as a wireless headset, that delivers sound close to an ear canal opening but does not block or obstruct the ear canal, is described. The audio device is carried by the ear using a structure that is configured to be positioned such that the device lightly clamps on the ear with an acoustic module, which may be positioned just anteriorly of the ear. The audio device is able to be positioned such that it remains in place even as the user moves his or her head. The audio device contemplated herein may include a variety of devices that include an over-the-ear hook, such as a wireless headset, hearing aid, eyeglasses, a protective hard hat, and other open ear audio devices.

Figure 1:
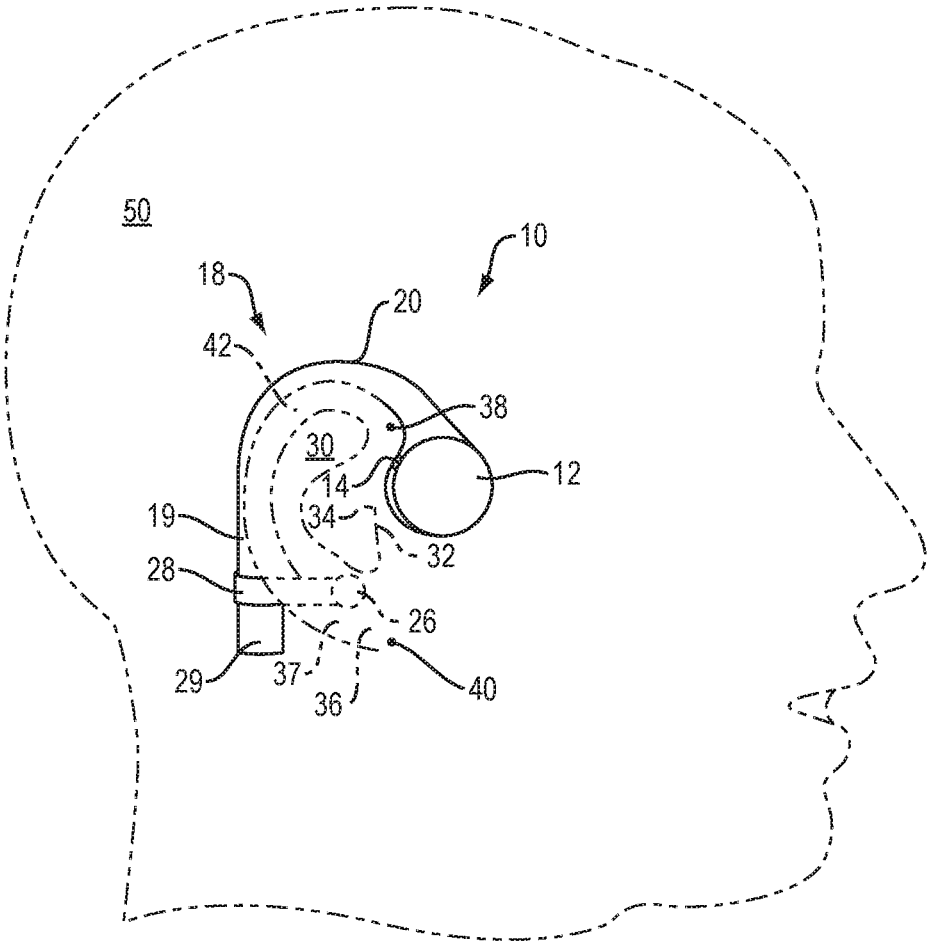
FIG. 1 is a side view of an audio device mounted to the right ear of a user.

Exemplary audio device 10 is depicted mounted to an ear in FIG. 1. Audio device 10 is carried on or proximate outer ear 30. Audio device 10 comprises acoustic module 12 that is configured to locate a sound-emitting opening 14 anteriorly of and proximate to the ear canal opening 34, which is behind (i.e., generally underneath) ear tragus 32. Acoustic modules (which may include one or more electro-acoustic transducers or drivers) that are configured to deliver sound to an ear are well known in the field and so are not further described herein. Audio device 10 further includes body 18 that carries acoustic module 12 and is configured to be worn on or abutting outer ear 30 such that body 18 contacts the outer ear and/or the portion of the head 50 that abuts the outer ear. Arm 28 is coupled to body 18. Arm 28 comprises a distal end 26 that is configured to contact at or near the ear root dimple 37 of the user. Arm 28 is configured to be moved in two directions, e.g., in a vertical direction or up-and-down direction along the length of body 18 and in a horizontal direction, pivoting about the axis of the body 18. In some implementations, arm 28 is compliant. The adjustability and compliance (in implementations where the arm is compliant) of the arm allows arm distal end 26 to be located at the bottom of the outer ear of people with different anatomies. Force provided in part by the compliance of the arm can cause the body and arm to gently grip the outer ear and/or the ear root dimple region when the audio device is worn in this manner. The grip helps to maintain audio device 10 on the ear as the user moves. Arm 28 can be adjustable to allow the user to adjust audio device 10 so it fits comfortably but firmly on the ear.

Body 18 can at least in part be shaped generally to follow the ear root, which is the intersection of the outer ear and the head. Contact along the ear root, or the outer ear and/or the head abutting the ear root (collectively termed the ear root region), can be at one or more locations along the ear root. However, since the human head has many shapes and sizes, body 18 does not necessarily contact the ear root of all users. Rather, it can be designed to have a shape such that it will, at least on most heads, contact the ear root region near the top of the ear. In implementations that include arm 28, the arm distal end can be configured to contact the outer ear and/or the portion of the head that abuts the outer ear at the bottom of the ear. Since, at least for most heads, the audio device with the arm may contact the ear/head at least at these two spaced locations, which are substantially or generally diametrically opposed, the result is a gripping force that maintains audio device 10 on the head as the head moves. For implementations where the arm is compliant, the compliance of the arm can cause a slight compressive force at the opposed contact locations and so can help achieve a grip on the head/ear that is sufficient to help retain the device in place on the head/ear as the head is moved. In one non-limiting example, one contact location is proximate the upper portion of the outer ear helix, and the opposed contact location is proximate the lower part of the ear or abutting head, such as near the otobasion inferius 40. Contact near the otobasion inferius 40 can be accomplished in any desired manner, for example without an arm, or with an arm that is fixed in location, or with an arm that is fixed and compliant. Body 18 can include a protrusion (in place of the arm) that is configured to contact the ear root region proximate otobasion inferius 40. In one non-limiting example, the opposed contact location is in or proximate the ear root dimple 37 that is located in most heads very close to or abutting or just posterior of the otobasion inferius 40. The audio device may be compliant at the portions that define each of two (or more) expected ear/head contact locations. For example, the body 18 of the audio device may include a compliant section at the contact location proximate the upper portion of the outer ear helix. In some implementations, the compliant section may have a compliance that is greater about one axis (e.g., a vertical axis) than it is about another axis (e.g., a horizontal axis).

Figure 2:
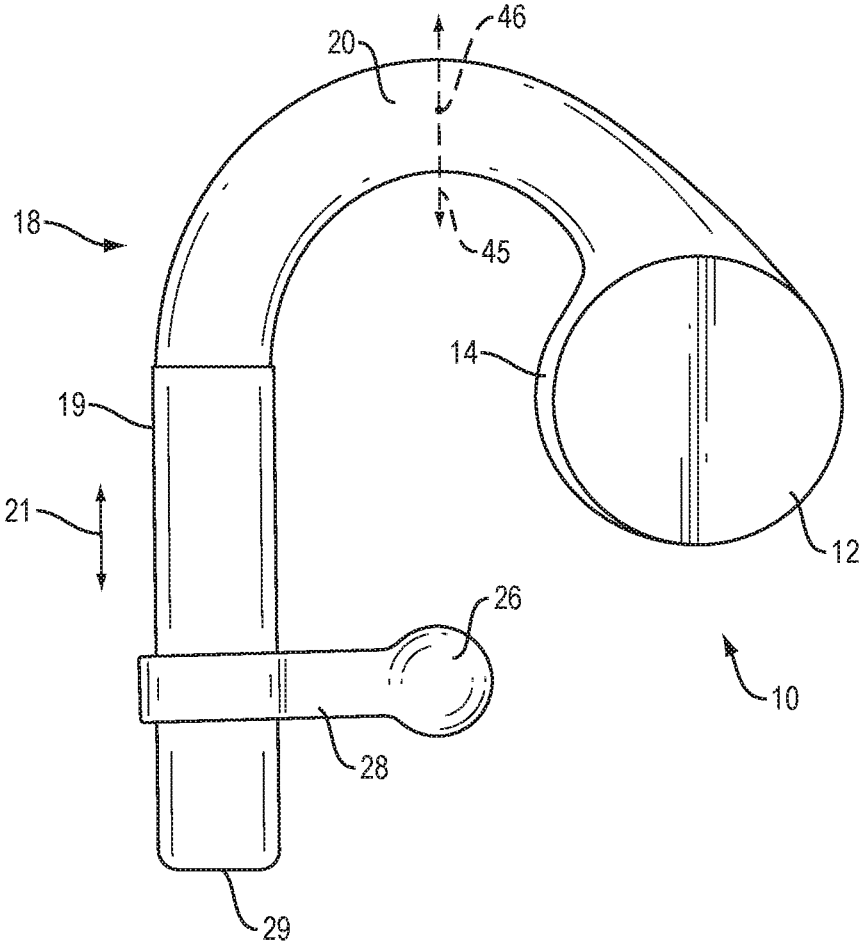
FIG. 2 is a side view of the audio device of FIG. 1.

In one non-limiting example, audio device body 18 comprises a hollow molded plastic housing portion 19, which may be used to house internal electrical components, such as a battery and circuitry. Alternatively, portion 19 can be a metal housing (e.g., stainless steel) and can have a silicone overcoat to increase comfort using a material that is appropriate for contact with the skin. Arm 28 (when present) is coupled to body 18 (e.g., to body portion 19), and is configured to be moved relative to body 18 and, in implementations where arm 28 is compliant, to bend. These movements and adjustments of arm 28 relative to body 18 allow arm distal end portion 26 to be located where desired relative to body 18. In some implementations, this allows distal end 26 to be located in or near the ear root dimple. This also allows the user to achieve a desired (and variable) clamping force of audio device 10 on the head and/or ear. In one non-limiting example, arm 28 is adjustable relative to body 18 to achieve the best fit and clamping force for the user. This adjustability of the arm is preferably but not necessarily up and down along the length of body portion 19, in the direction of arrow 21, FIG. 2. Also, the angular position of arm distal end 26 relative to body portion 19 can be made adjustable (e.g., to accommodate different positions of ear root dimples) by configuring the arm to bend and/or to rotate about the longitudinal axis of body portion 19. The horizontal and vertical position of arm distal end 26, and the amount of torque applied to body 18 via arm 28 and its distal end 26, can be made adjustable by configuring arm 28 such that it can be bent. Bending can be in one or both of the vertical direction and the horizontal direction. In one non-limiting example, both bending modes can be accommodated by fabricating the arm or another protrusion of an elastomer (such as a silicone or a thermoplastic elastomer) that can be bent or otherwise manipulated, for example up and down and side-to-side relative to the arm longitudinal axis. Horizontal bending can apply a torque to body 18, which can force acoustic module 12 against the head by pushing outward on the inside of the earlobe. This can help stabilize audio device 10 on the head. In some implementations, multiple sizes of arms 28 can be provided, having varying lengths of arm distal end 26. For example, a small, medium, and large size arm 28 may be used to accommodate various head/ear sizes.

Audio device body 18 can at least in part be shaped to generally follow the shape of the ear root. The anatomy of the ear and head adjacent to the ear, and manners in which an audio device can be carried on or near the ear, are further described in international patent application PCT/US18/51450 filed on Sep. 18, 2018, the entire disclosure of which is incorporated herein by reference for all purposes. Accordingly, not all aspects of the anatomy and fitting of an audio device to an ear are specifically described herein. Body 18 in this example includes generally "C"-shaped portion 20 that extends from an upper end (which when worn on the head may be proximate otobasion superius 38) where it is coupled to acoustic module 12, to a lower end where it is coupled to portion 19. While portion 19 is shown as a separate piece from the rest of body 18, in some implementations, portion 19 and the rest of body 18 may be integrally formed. In some implementations, some or all of body 18 is compliant. For example, the portion of body 18 that comes in contact with a wearer's ear/head may be compliant. Compliance can be accomplished in one or more mechanical manners. Examples include the choice of materials (e.g., using compliant materials such as elastomers or spring steel or the like) and/or a construction to achieve compliance (e.g., including a differentially-bending member in the construction). Generally, but not necessarily, body 18 (e.g., portion 20) follows the ear root from the otobasion superius 38 (which is at the upper end of the ear root) to about the otobasion posterius (not shown).

In implementations with arm 28, arm distal end 26 can be constructed and arranged to fit into or near the dimple or depression 37 (i.e., the ear root dimple) that is found in most people behind earlobe 36 and just posterior of the otobasion inferius 40. In some implementations, distal end 26 can be generally round (e.g., generally spherical as shown in the drawings), having an arc-shaped surface that provides for an ear root dimple region contact location along the arc, thus accommodating different head and ear sizes and shapes. Alternative shapes for distal end 26 include a half sphere, truncated sphere, cone, truncated cone, cylinder, and others. Arm distal end 26 can be made from or include a compliant material (or made compliant in another manner), so it can provide some grip to the head/ear.

In some implementations, body portion 20 at or around the ear root region proximate the upper portion 42 of the outer ear helix (which is generally the highest point of the outer ear) has compliance. Since ear portion 42 is generally diametrically opposed to ear root dimple 37 (and to device portion 26 which contacts the ear root dimple), a compliance in body portion 20 will provide a gripping force that will tend to hold audio device 10 on the head/ear even as the head is moved.

Since the device-to-ear/head contact points are, at least for most users, both in the vicinity of the ear root (proximate upper ear upper portion 42 and in the vicinity of ear root dimple 37), the contact points are generally diametrically opposed. The opposed compliances create a resultant force on the device (the sum of contact force vectors, not accounting for gravity) that lies about in the line between the opposed contact regions. In this way, the device can be held stable on the ear even in the absence of high contact friction (which adds to stabilization forces and so only helps to keep the device in place). Contrast this to a situation where the lower contact region is substantially higher up on the back of the ear. This would cause a resultant force on the device that tended to push and rotate it up and off the ear. By arranging the contact forces roughly diametrically opposed on the ear, and by creating points of contact on either side of or over an area of the upper ear root ridge 42, the device can accommodate a wider range of orientations and inertial conditions where the forces can balance, and the device can thus remain on the ear.

Stability is in part accomplished by a top-to-bottom clamping force on the outer ear, due to generally diametrically opposed clamping forces at the ear root ridge proximate the upper portion of the helix and at the ear root dimple. Clamping force at the ear root ridge proximate the upper portion of the helix is accomplished in this non-limiting example by compliant arc-shaped body portion 20 that at least in part can sit behind upper helix portion 42, typically against one or both of the outer ear and the portion of the head adjacent to the outer ear. Body portion 20 is relatively more compliant about vertical axis 45 and is less compliant about orthogonal axis 46 (which is into and out of the page in FIG. 2). See FIG. 2. The compliance about axis 45 allows audio device 10 to be lightly preloaded against the side of the head. The stiffness about axis 46 helps maintain the general arc shape of portion 20 so that acoustic module 12 remains properly positioned near the front of the ear; if portion 20 flexes about axis 46 then if arm 28 is positioned such that the grip on the ear is overly tight the arc-shape of portion 20 could spread apart (i.e., its radius of curvature could enlarge), pulling the acoustic module 12 away from the front of the ear. Since arm distal end 26 is typically fixed in position behind/underneath the ear, such bending could cause acoustic module 12 to move away from the ear which would move sound-emitting opening 14 farther from the ear canal and thus have a detrimental effect on the quality of the sound heard by the user.

One non-limiting example of the subject audio device, and steps involved in manufacturing the audio device, are shown in FIGS. 3-11. Audio device 170, shown fully assembled in FIGS. 10 and 11, includes arc-shaped compliant portion 172 that is in at least some respects functionally equivalent to portion 20, FIGS. 1 and 2. Portion 172 is relatively more compliant about axis 173 than it is about axis 174. In some implementations, portion 172 runs from the inner end 176 of acoustic module 177 to the inner end 178 of battery housing 179. In general, the length of portion 172 is sufficient to pass over the upper portion of the outer ear helix in most people while also accommodating both inner spine member 90 and the bend along the length of portion 172 that is described below. The length of compliant portion 172 can be determined by its target compliance. Given the particular overmold material, the flexible printed circuit (described below), and the cross-sectional geometry, the length of portion 172 can in some implementations be chosen so that portion 172 is sufficiently compliant that it would not bend the top of the ear so much that it would be uncomfortable to wear.

Figure 3:
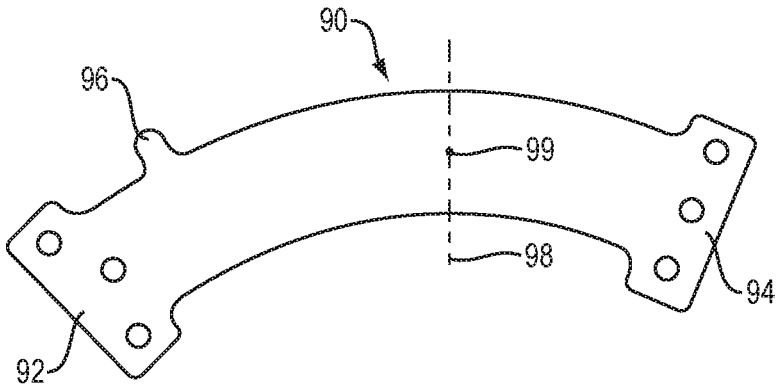
FIG. 3 illustrates a spine member for an audio device.

Portion 172 is configured to be differentially compliant, as follows. Differentially compliant inner spine member 90, FIG. 3, is compliant about vertical axis 98 and is less compliant (stiffer) about axis 99 (which is into and out of the page in FIG. 3). Ideally spine member 90 would be about 188 times stiffer in the horizontal axis than in the vertical axis. In an actual manufactured device (as further described below), this ratio may be close to 10. In some implementations, spine member 90 can be constructed of plastic, for example polycarbonate. Alternative materials include: metal (e.g., steel or stainless steel), metal mesh, nitinol, beta-titanium, or polyimide. In some implementations, the spine member 90 is a thin piece of polycarbonate material. The spine member may have a thickness of about 0.05 mm-0.25 mm, and more preferably about 0.125 mm. This thickness range for polycarbonate provides a good compromise between strength and compliance and is appropriate to achieve a desired flexibility about axis 98. A goal of the spine member and its material is to provide a desired compliance/stiffness about both axes, while also being able to bond to other materials from which the audio device is made, as explained below. The width of the spine member is selected in part to achieve a desired stiffness about axis 99, while its length is also selected in part to achieve a desired stiffness about axis 99. Spine member 90 could be made wider, which could increase the stiffness about axis 46 and may further protect the flexible printed circuit that overlies the spine member, as described below. In some implementations, ends 92 and 94 are enlarged and each include several small through-holes; these features help to bond member 90 to the overlaying material (which, in some implementations, may be injection molded), as explained below. Optional extension feature 96 assists with registration of member 90 in the mold.

Spine member 90 can be constructed in different manners. For example, spine member 90 could comprise strong wires (e.g., Kevlar wires) that are held in position at least in part by the overmold. Such wires would preferably go through the middle of the housing to minimize bending of the wires and locate the wires as close as possible to neutral axis. It may be preferable to have wires as straight as possible, for example by locating them in a straight section of portion 172. Also, the wires would preferably be somewhat separated. The wires could be terminated (e.g., by tying them off) and then overmolding. Alternatively, the Kevlar wires could be in a wire bundle.

Figure 4:
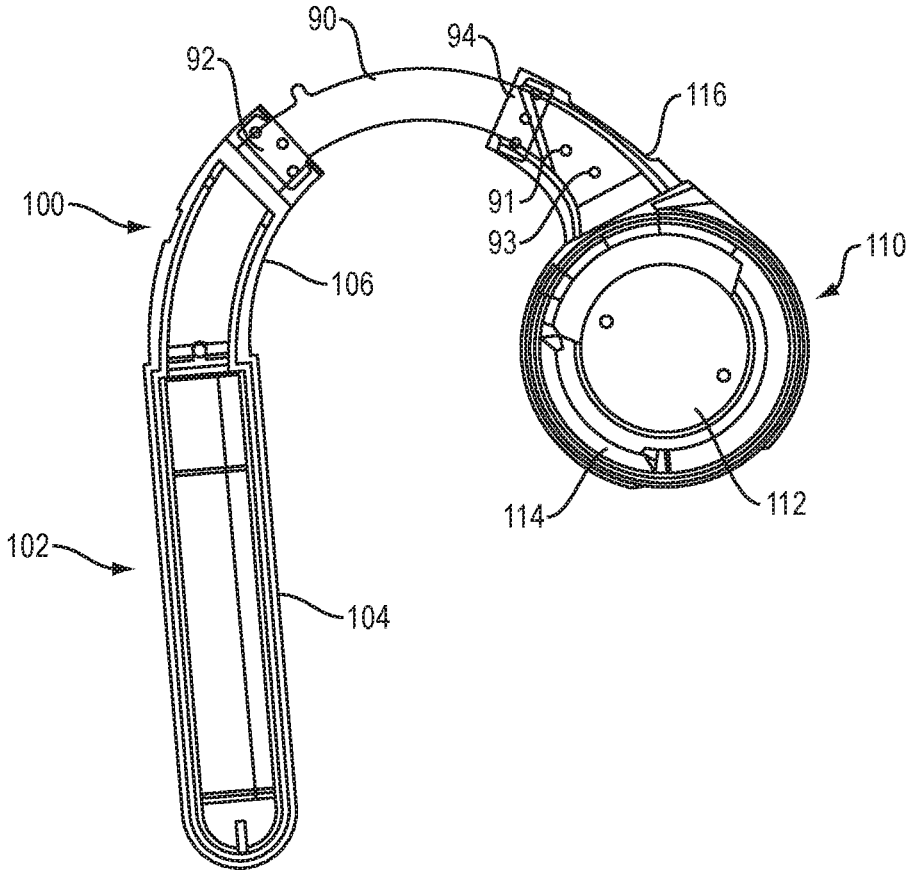
FIG. 4 illustrates a partial assembly of an audio device.

FIG. 4 illustrates partial assembly 100. In some implementations, the partial assembly 100 is fabricated as follows. Spine member 90 is inserted into an injection molding tool along with metal contacts' 91 and 93 which will act as electrical contacts for recharging of the battery. A suitable plastic (such as a polycarbonate/acrylonitrile butadiene styrene) is injected and forms half 102 of the battery/electronics housing (with battery/electronics-holding portion 104 and integral extension 106 that overlies and encompasses end 92 of spine member 90), and half 110 of the acoustic module (with inner cavity 112 that will contain the electro-acoustic transducer, cavity sound-emitting opening 114, and integral extension 116 that overlies and encompasses end 94 of spine member 90, and also captures contacts 91 and 93).

Figure 5:
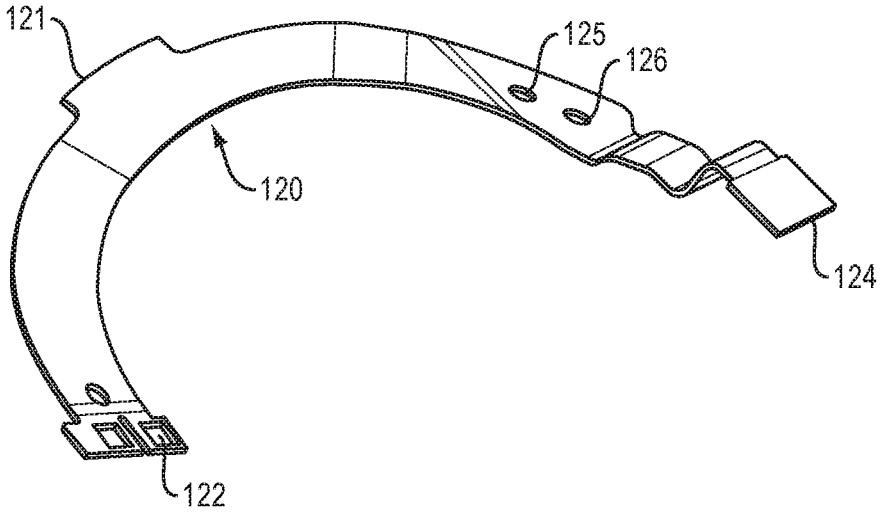
FIG. 5 illustrate a flexible printed circuit for an audio device
Figure 6:
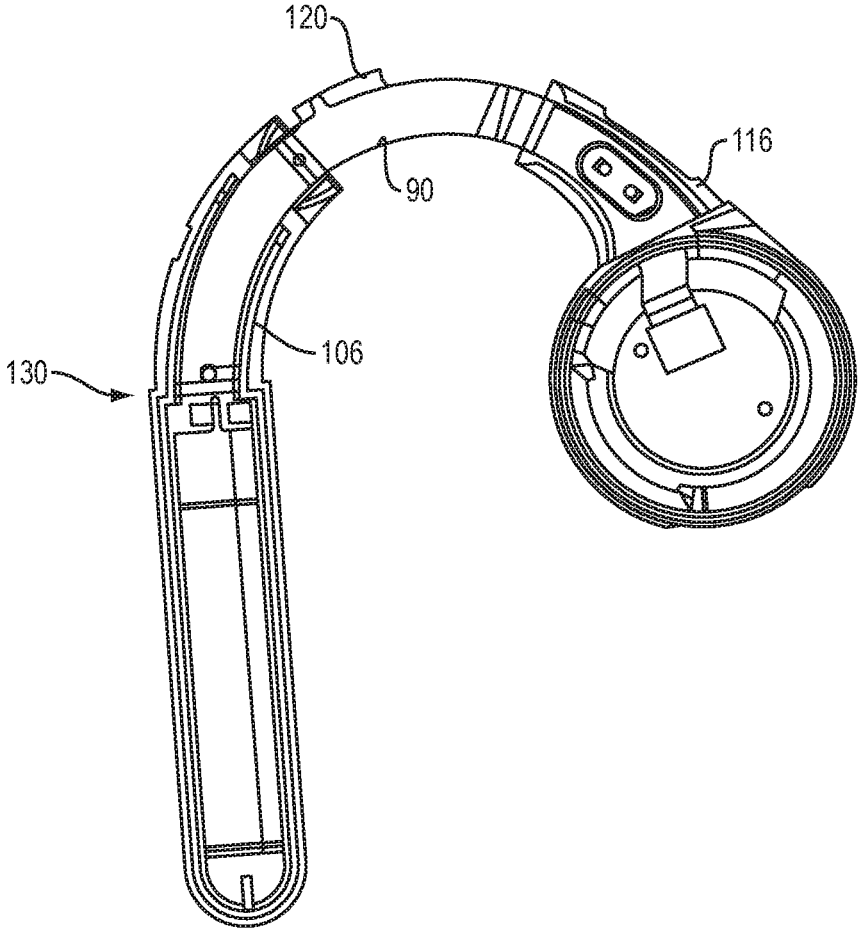
FIG. 6 illustrates a further partial assembly of the audio device of FIG. 4.

FIG. 5 illustrates an implementation of a flexible printed circuit (FPC) member 120 that has end 122 to be electrically coupled to the battery, and end 124 to be electrically coupled to the electro-acoustic transducer. End 124 may be configured to plug into a printed circuit board (PCB) in the acoustic housing (not shown) to which the transducer can be soldered. Optional openings 125 and 126 may be used to accommodate charging contacts 91 and 93, and optional tab 120 may be used to assist with mold alignment. FPC member 120 is fed through extensions 116 and 106, and is secured to spine member 90. FPC member 120 can be secured to spine member 90 by any appropriate connection, including for example a mechanical interconnection or an adhesive interconnection. In some implementations the interconnection is accomplished with a pressure-sensitive adhesive or a heat-activated film. This interconnection helps retain the FPC member 120 in place during the next operations. Configuring FPC member 120 so that it generally follows the shape of and overlies spine member 90 also helps to reduce bending of the FPC, which reduces strain on the FPC. This creates partial assembly 130, FIG. 6.

Figure 7:
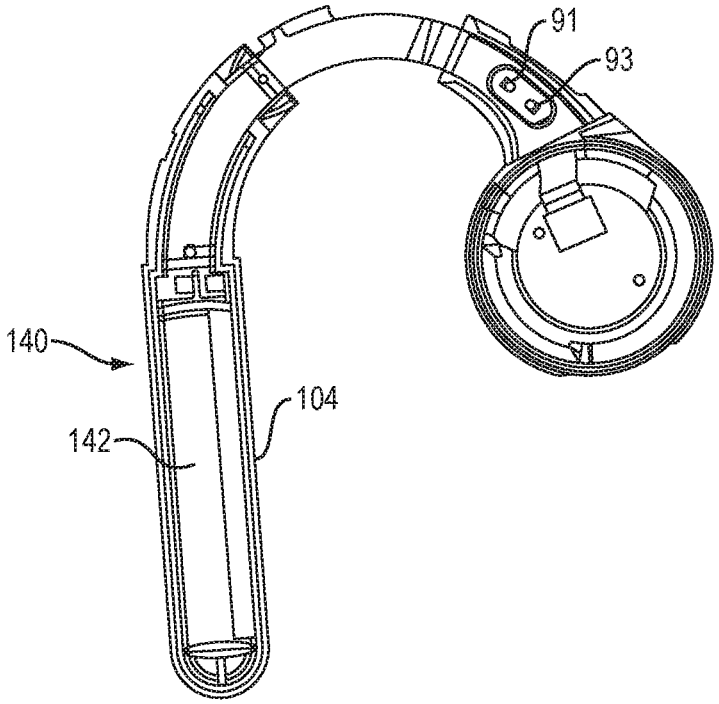
FIG. 7 illustrates a further partial assembly of the audio device of FIG. 6.
Figure 8:
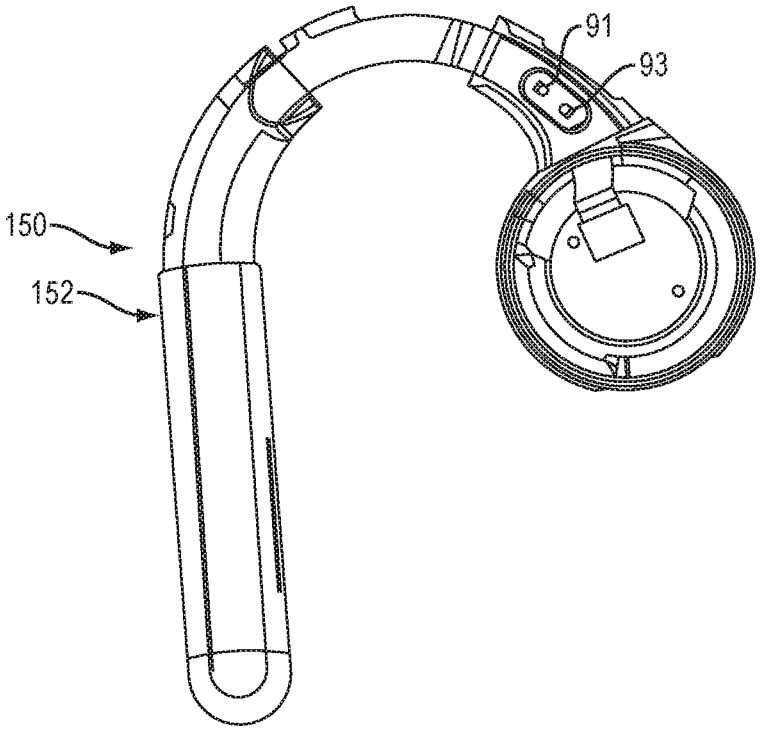
FIG. 8 illustrates a further partial assembly of the audio device of FIG. 7.

FIG. 7 illustrates further partial assembly 140 in which rechargeable battery 142 is placed into portion 104 and FPC 120 is soldered to battery 142 and to charging pins 91 and 93. A separately-molded top half of the battery housing is then glued on to create finished battery housing/extension member 152 of further partial assembly 150, FIG. 8.

Figure 9:
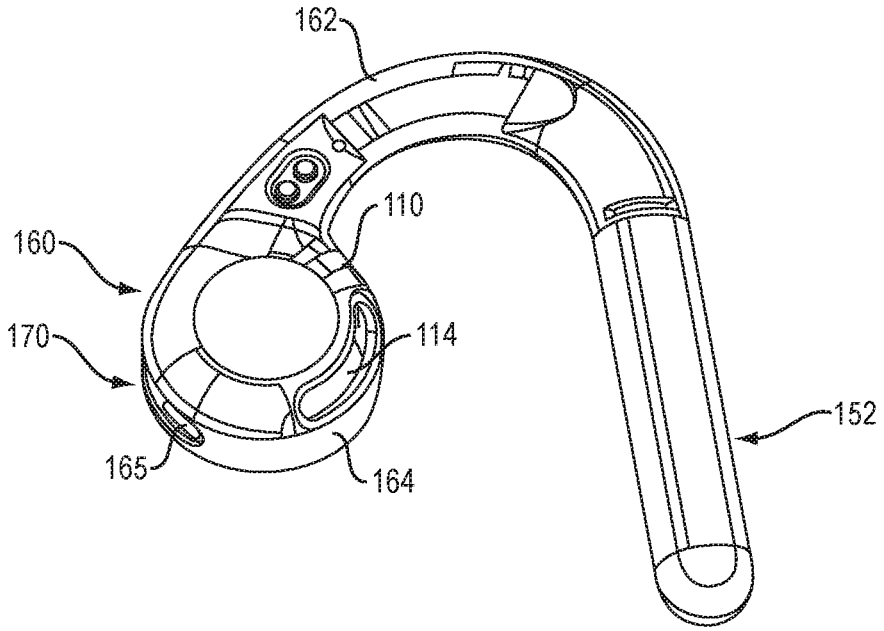
FIG. 9 illustrates a further partial assembly of the audio device of FIG. 8.
Figure 10:
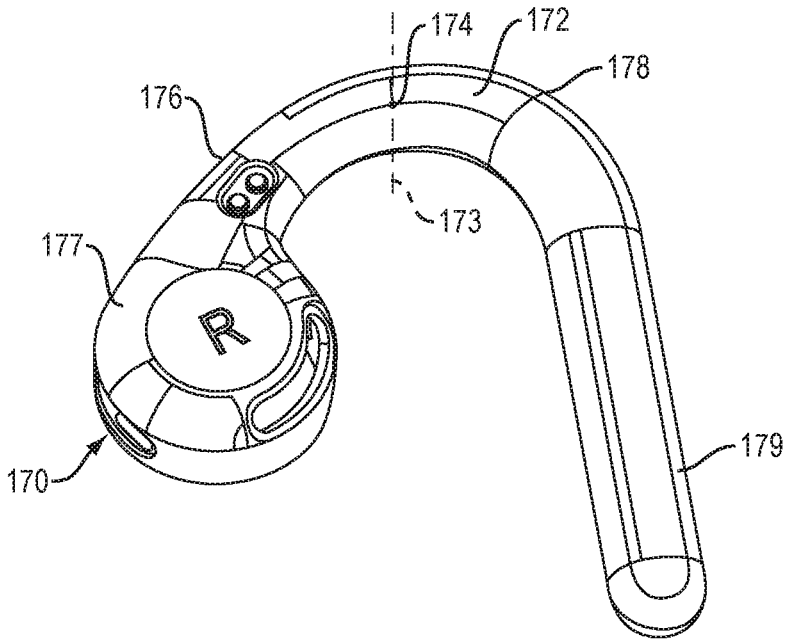
FIG. 10 illustrates the completed audio device.

Partial assembly 150 is then placed into a mold and a soft flexible material that is comfortable when placed against the skin (such as a thermoplastic elastomer (TPE) or a thermoplastic urethane (TPU) or a silicone) is injection molded behind spine member 90 to create portion 162, FIG. 9. The injection molding also forms the second half 164 of acoustic module 170, and in some implementations defines a second sound-emitting opening 165. The TPE, TPU or silicone also bonds to the plastic material of the spine member and the battery housing and the acoustic module so as to create a more robust further partial assembly 160, FIG. 9.

In the next step in the manufacturing process, partial assembly 160 is kept in the cavity half of the mold tool and the core is replaced for a second shot of the TPE/TPU/silicone material that fully encapsulates spine member 90 and FPC 120, and also covers acoustic module half 110 with this same soft material, to create the final audio device 170. The two-shot molding process helps to minimize unwanted bending of the FPC during the molding process. The two-shot assembly process helps secure the flex band 90 in the center of the housing, which helps control the contribution the overmold has to the overall stiffness. Atm 28 can then be fitted over battery housing 179. In some implementations, the overmold material does not have a uniform thickness along the length of the audio device 170, but rather transitions between a relatively thinner and thicker wall thickness. For example, the compliant portion 172 may be relatively thinner compared to the housing closer to the acoustic module 177 and battery housing 179 (see FIG. 11). While the audio device 170 shown is configured to be coupled to a right ear, a mirror-image version could be produced to couple to a left ear. It should be understood that the assembly process is exemplary and other steps or techniques could be used.

Figure 11:
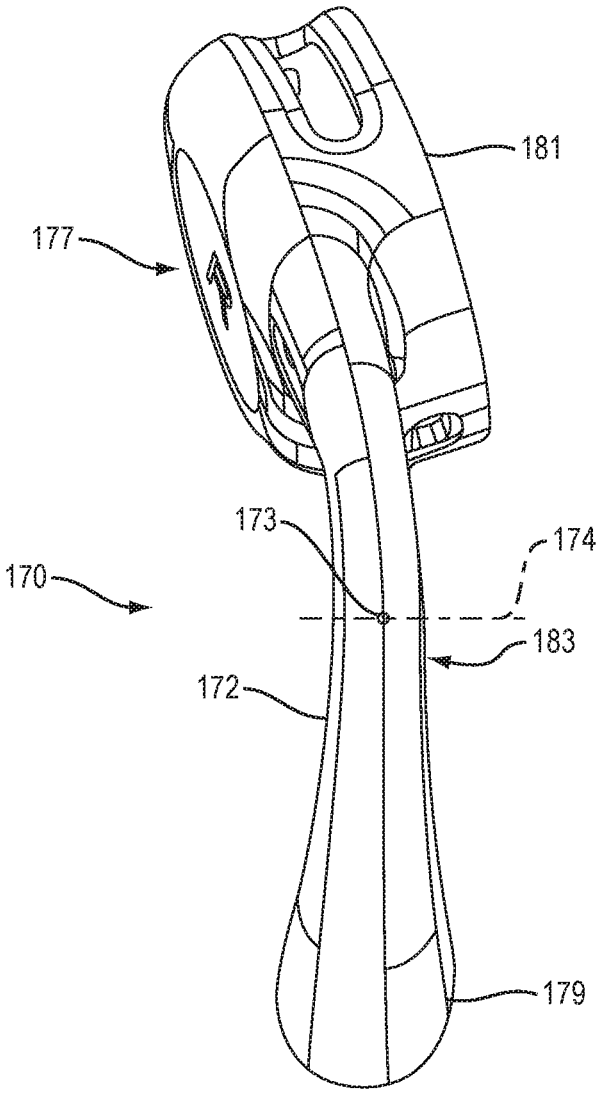
FIG. 11 is a top view of the audio device of FIG. 10.

Referring to FIG. 11, in audio device 170 compliant portion 172 is relatively more compliant about axis 173 (which is into and out of the page) than it is about axis 174. In some implementations, portion 172 has an out of plane curvature along at least a portion of its extent from acoustic module 177 to battery housing 179, which can be created by defining a bend along its length around location 183. Since there is compliance about axis 173, this bend can be straightened as the audio device is placed over the top of the ear. This creates a preload on inner face 181 of acoustic module 177. In one non-limiting example the stiffness of bending about axis 173 is two grams per millimeter. Since face 181 lies against the user's head, this preload helps to keep the audio device in place, with sound-emitting opening 114 just in front of the tragus. In one non-limiting example, opening 114 emits sound from the front of the transducer and opening 165 emits sound from the rear of the transducer, to create a dipole-like behavior where sound is cancelled in the far field, in order to inhibit leakage of sound to others located nearby to the user.

A number of implementations have been described. Nevertheless, it will be understood that additional modifications may be made without departing from the scope of the inventive concepts described herein, and, accordingly, other examples are within the scope of the following claims.

What is claimed is:

1. An audio device, comprising:

a body configured to be worn on or abutting an outer ear of a user, wherein the body comprises an upper curved portion that is configured to be located proximate the upper portion of the outer ear helix and is relatively more compliant about a vertical axis and is less compliant about a horizontal axis; and an acoustic module coupled to the upper curved portion of the body, wherein the acoustic module is configured to locate a sound-emitting opening spaced from and proximate the user's ear canal opening when the body is worn on or abutting the outer ear of the user, such that the ear canal opening is not covered by the acoustic module.

2. The audio device of claim 1, wherein the sound-emitting opening is located anteriorly of and proximate the tragus of the ear.

3. The audio device of claim 1, wherein the acoustic module is configured to contact the head anteriorly of and proximate the ear.

4. The audio device of claim 1, wherein the body further comprises a lower rear portion that is configured to be located at least in part proximate the otobasion inferius.

5. The audio device of claim 4, wherein the lower rear portion of the body comprises a compliant mechanical structure that is configured to be located proximate the ear root dimple.

6. The audio device of claim 4, wherein the lower rear portion of the body is configured to house a battery power source.

7. The audio device of claim 1, wherein the upper curved portion comprises an inner spine member covered with a soft flexible material.

8. The audio device of claim 7, wherein the soft flexible material comprises a material selected from the group of materials consisting of a thermoplastic elastomer, a thermoplastic urethane, and a silicone.

9. The audio device of claim 7, wherein the soft flexible material is overmolded on the inner spine member.

10. The audio device of claim 9, wherein the overmolding is accomplished in two separate overmolding shots.

11. The audio device of claim 7, wherein the upper curved portion further comprises a flexible printed circuit element that is configured to electrically connect the acoustic module to the lower rear portion of the body.

12. The audio device of claim 7, wherein the inner spine member comprises at least one of polycarbonate, steel, stainless steel, nitinol, or polyimide.

13. The audio device of claim 7, wherein the inner spine member is relatively more compliant about a vertical axis and is less compliant about a horizontal axis.

14. The audio device of claim 1, wherein the upper curved portion of the body extends generally along an arc and has an out of plane curvature along its extent.

15. The audio device of claim 1, wherein the upper curved portion of the body defines a bend along its length and is configured to be flattened when the body is worn on or abutting the ear, to create forces that pull the acoustic module toward the user's head.

16. An audio device, comprising:

a body configured to be worn on or abutting an outer ear of a user, wherein the body comprises an upper curved portion that comprises an inner flexible spine member covered with a soft flexible material and is configured to be located proximate the upper portion of the outer ear helix, wherein the upper curved portion of the body is relatively more compliant about a vertical axis and is less compliant about a horizontal axis, and the body further comprises a lower rear portion that is configured to be located at least in part proximate the otobasion inferius; and an acoustic module coupled to the upper curved portion of the body, wherein the acoustic module is configured to contact the user's head spaced from and proximate the ear canal opening, such that the ear canal opening is not covered by the acoustic module, and locate a sound-emitting opening spaced from and proximate the tragus of the ear when the body is worn on or abutting the outer ear of the user.

17. The audio device of claim 16, wherein the upper curved portion further comprises a flexible printed circuit element that is configured to electrically connect the acoustic module to the lower rear portion of the body.

18. The audio device of claim 16, wherein the soft flexible material is overmolded on the inner flexible spine member, wherein the overmolding is accomplished in two separate overmolding shots.

19. The audio device of claim 16, wherein the upper curved portion of the body extends generally along an arc, has an out of plane curvature along its extent, and is configured to be flattened when the body is worn on or abutting the ear, to create forces that pull the acoustic module toward the user's head.

20. An audio device, comprising:

a body configured to be worn on or abutting an outer ear of a user, wherein the body comprises:

an upper curved portion that comprises an inner flexible spine member covered with a soft flexible material, wherein the upper curved portion extends generally along an arc and has an out of plane curvature along its extent, and is configured to be located proximate the upper portion of the outer ear helix, and wherein the upper curved portion is relatively more compliant about a vertical axis and is less compliant about a horizontal axis; and a lower rear portion that is configured to house a battery power source and be located at least in part proximate the otobasion inferius;

an acoustic module coupled to the upper curved portion of the body, wherein the acoustic module is configured to contact the user's head spaced from and proximate the ear canal opening, such that the ear canal opening is not covered by the acoustic module, and locate a sound-emitting opening spaced from and proximate the tragus of the ear when the body is worn on or abutting the outer ear;

wherein the upper curved portion of the body further comprises a flexible printed circuit element that is configured to electrically connect the acoustic module to the lower rear portion of the body; and wherein the upper curved portion of the body defines a bend along its length and is configured to be flattened when the body is worn on or abutting the ear, to create forces that pull the acoustic module toward the user's head.

* * * * *